United States Patent [19]

Morgand

[11] Patent Number: 5,074,492

[45] Date of Patent: Dec. 24, 1991

[54] SYSTEM FOR STEERING A MISSILE BY MEANS OF LATERAL NOZZLES

[75] Inventor: Jean-Pierre Morgand, Paris, France

[73] Assignee: Société Anonyme dite: Aerospatiale Societe Nationale Industrielle, Paris, France

[21] Appl. No.: 665,895

[22] Filed: Mar. 7, 1991

[30] Foreign Application Priority Data

Mar. 14, 1990 [FR] France ..... 90 03252

[51] Int. Cl.[5] ..... F42B 10/66

[52] U.S. Cl. ..... 244/3.22

[58] Field of Search ..... 244/3.22; 239/265.25, 239/265.27, 265.29

[56] References Cited

U.S. PATENT DOCUMENTS

| | | | |
|---|---|---|---|
| 3,136,250 | 6/1964 | Humphrey | 244/3.22 |
| 4,085,909 | 4/1978 | East et al. | 244/3.22 |
| 4,441,670 | 4/1984 | Crepin | 244/3.22 |
| 4,531,693 | 7/1985 | Raynaud et al. | 244/3.22 |
| 4,632,336 | 12/1986 | Crepin | 244/3.22 |

FOREIGN PATENT DOCUMENTS

| | | |
|---|---|---|
| 0064433 | 11/1982 | European Pat. Off. . |
| 2743371 | 4/1978 | Fed. Rep. of Germany . |
| 2620812 | 3/1989 | France . |
| 2622066 | 4/1989 | France . |

*Primary Examiner*—Charles T. Jordan

*Attorney, Agent, or Firm*—Marshall, O'Toole, Gerstein, Murray & Bicknell

[57] ABSTRACT

A system is disclosed for steering a missile by means of gas jets, comprising a gas generator connectable to at least a pair of lateral nozzles via rotary valving means, movable under the action of drive means and controlling the passage of the gases through said nozzles. According to the invention:

with each nozzle is associated an individual rotary valving member;

each valving member is controlled in rotation by a piston dividing a jack into two chambers of different cross sections, said chambers each receiving a part of the gas generated by said gas generator, and the position of said piston being controlled by controlling the flowrate of said gas through the chamber with largest cross section, and the two valving members are connected together by a mechanical connection so that, when one valving member rotates and tends to close the associated nozzle, the other valving member rotates by the same angular amplitude and tends to free the associated nozzle.

14 Claims, 6 Drawing Sheets

SYSTEM FOR STEERING A MISSILE BY MEANS OF LATERAL NOZZLES

BACKGROUND OF THE INVENTION

1. Field of the Invention

The invention relates to a system for steering a missile by means of lateral gas jets and a missile comprising such a system.

When a missile is to be steered with high load factors, lateral nozzles are provided on board this missile which are fed with gas either from a gas generator of the main thrustor, or from a gas generator specially provided for this purpose. Thus, lateral gas jets are provided generating transverse propulsive forces capable of rapidly and appreciably changing the direction of the trajectory of the missile. The action lines of such transverse forces can be caused to pass through the center of gravity of the missile, or at least in the vicinity thereof and then the missile is said to be force steered, the response time to the control being then particularly fast. However, this is not obligatory and the lines of action of said transverse forces may pass through points of the axis of the missile different from the center of gravity. Said transverse forces then create, similarly to conventional aerodynamic steering surfaces, moments for controlling the missile in attitude with respect to the center of gravity.

2. Description of the Prior Art

From the U.S. Pat. No. 4,531,693 and the U.S. Pat. No. FR-A-2 620 812, a system is known for steering a missile by means of lateral gas jets, comprising a gas generator able to be connected to at least a pair of lateral nozzles via rotary valving members, moving under the action of the drive means and controlling the passage of the gases through said nozzles.

In the system of the American patent U.S. Pat. No. 4,531,693, with each of said nozzles there is associated an individual rotary valving member, itself being controlled individually by an oscillator. With this structure, each rotary valving member may have low inertia so that the response time of the valving means and so of the steering may be very small.

Furthermore, because there is an oscillator for each of said valving members, it is easy to control the whole of said oscillators so that, at all times, the position of each valving member (completely open, total closure or partial closure) corresponds exactly to the steering phase and/or to the state of said gas generator. On the other hand, because said rotary valving means are controlled by oscillators, a controlled position of a valving member with respect to the corresponding nozzle is not reached directly, but by a train of oscillations. In addition, these oscillations may induce parasite oscillations in the missile, complicating steering thereof.

On the other hand, in the system of the French patent FR-A-2 620 812, to provide the necessary control coupling between said nozzles, a rotary valving means is provided common to the two nozzles, this valving means being controlled by the piston of a jack whose two chambers, having different cross sections, receive a part of the gas generated by said generator, the position of the piston of said jack, and so that of said valving means, being controlled by controlling the flowrate of said gas in that one of said chambers of the jack which has the largest cross section. With such a control, the rotary valving means may reach its position directly, without oscillations. However, in this case, the rotary valving means is necessarily cumbersome, so that its inertia and its response time are high.

SUMMARY OF THE INVENTION

The object of the present invention is to provide a system of the above mentioned type having both valving means with low inertia and valving control without oscillations.

For this, according to the invention, the system for steering a missile by means of gas jets, comprising a gas generator connectable to at least a pair of lateral nozzles via rotary valving means, movable under the action of drive means and controlling the passage of the gases through said nozzles is remarkable in that:

with each nozzle is associated an individual rotary valving member;

each valving member is controlled in rotation by a piston dividing a jack into two chambers of different cross sections, said chambers each receiving a part of the gas generated by said gas generator, and the position of said piston being controlled by controlling the flowrate of said gas through the chamber with largest cross section; and the two valving members are connected together by a mechanical connection so that, when one valving member rotates in one direction, the other valving member rotates in the opposite direction, by the same angular amplitude.

Thus, each valving member may have low inertia, and the positioning of each valving member is determined, without oscillations, both by the corresponding jack and by the action of said mechanical connection.

In order to reduce the inertia of the valving members as much as possible, each nozzle has an oblong section, at least in the vicinity of its neck cooperating with a valving member. Thus, each valving member may be formed by a shaft fast with a projecting radial plate whose longitudinal end face cooperates with the neck of the corresponding nozzle.

Advantageously, in order to reduce the torque exerted by the gases on the valving members, tending to oppose opening thereof, the lateral face of the radial plate, opposite the neck of the nozzle in the open position of said valving member, is concave and curved.

Preferably, said valving members are mounted in a rigid block integral with the structure of said missile.

When said nozzles are formed in wings of said missile integral with the skin thereof, it is advantageous for the feet of said nozzles to be fitted with a sliding fit in said rigid block. Thus, the deformation of said nozzles is decoupled from the rest of the missile.

Control of the gas flow through a jack is preferably obtained by means of a linear motor moving a ball in a bell-mouth portion provided in the circuit of said gas flow. Preferably, the valving members of the two nozzles are controlled by the same motor.

Preferably, said mechanical connection comprises two links, respectively interlocked for rotation with a valving member, said links being connected together by their facing free ends via an articulation, whose axis is able to move longitudinally with respect to one of said links. Such an articulation may be of any known type, for example comprising a ball or roller rolling in a slot and is disposed away from the gas flows emitted by the gas generator.

Advantageously, each link is interlocked for rotation with the shaft of the corresponding valving member and, at its end opposite said articulation with the other link, each link is articulated to the piston of the corresponding jack.

In the case where the two nozzles are diametrically opposite with respect to the body of the missile, it is advantageous, in the neutral position of the system, for the two articulations of the links to said jacks and the articulation between said links to be aligned and for the two valving members to half close the corresponding nozzles.

For controlling the system, downstream of its neck cooperating with the corresponding rotary valving member, each nozzle comprises a gas tranquillizing chamber connected to said nozzle, on the side opposite said neck, by a restriction such that the gas flow inside said nozzle is subsonic. Thus, it is possible to steer the missile as a function of the pressure measured inside said tranquillizing chambers.

For this, a device is provided for measuring the pressure in each tranquillizing chamber.

BRIEF DESCRIPTION OF THE DRAWINGS

The figures of the accompanying drawings will better show how the invention may be put into practice. In these figures, identical references designate similar elements.

DESCRIPTION OF THE PREFERRED EMBODIMENT

Figure 1:
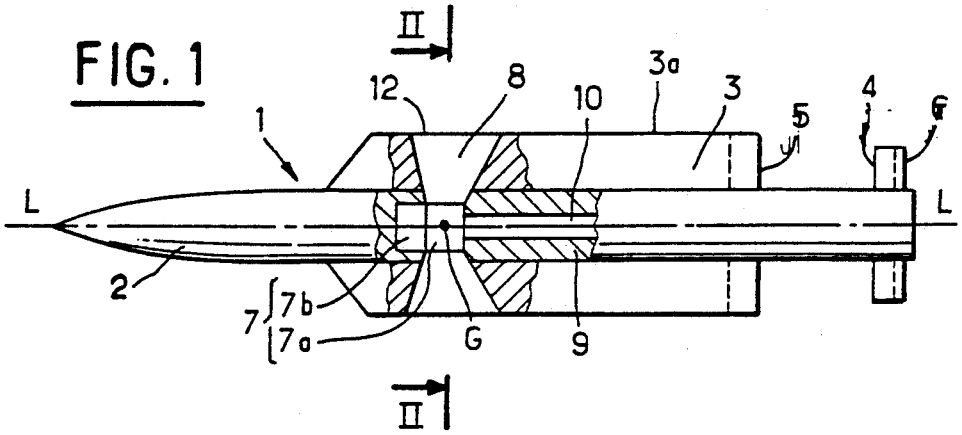
FIG. 1 is a schematic view of one embodiment of the missile according to the invention, with parts cut away.
Figure 2:
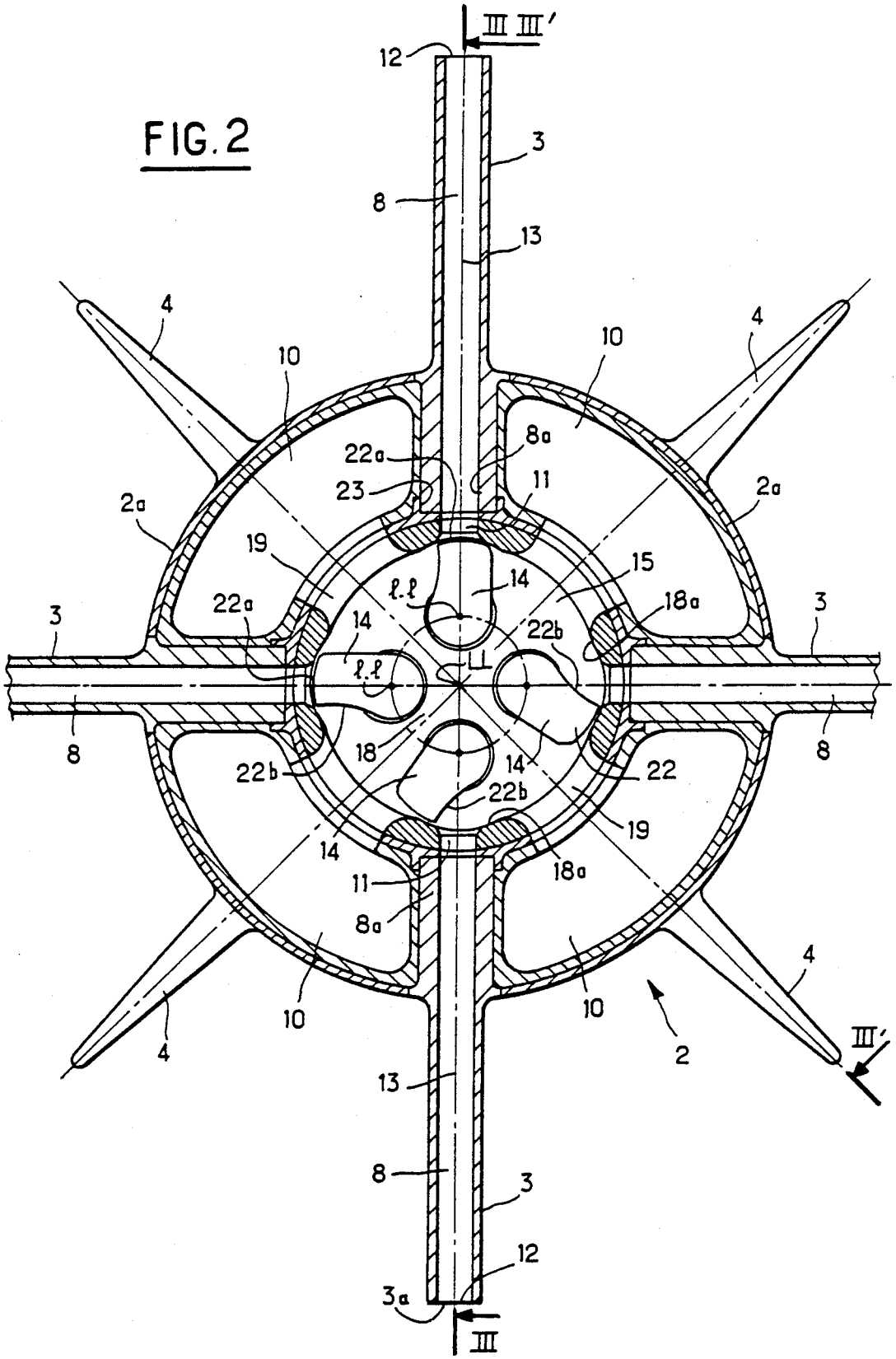
FIG. 2 is a partial cross section, on a larger scale, of the missile according to the invention through line II—II of FIG. 1.
Figure 3:
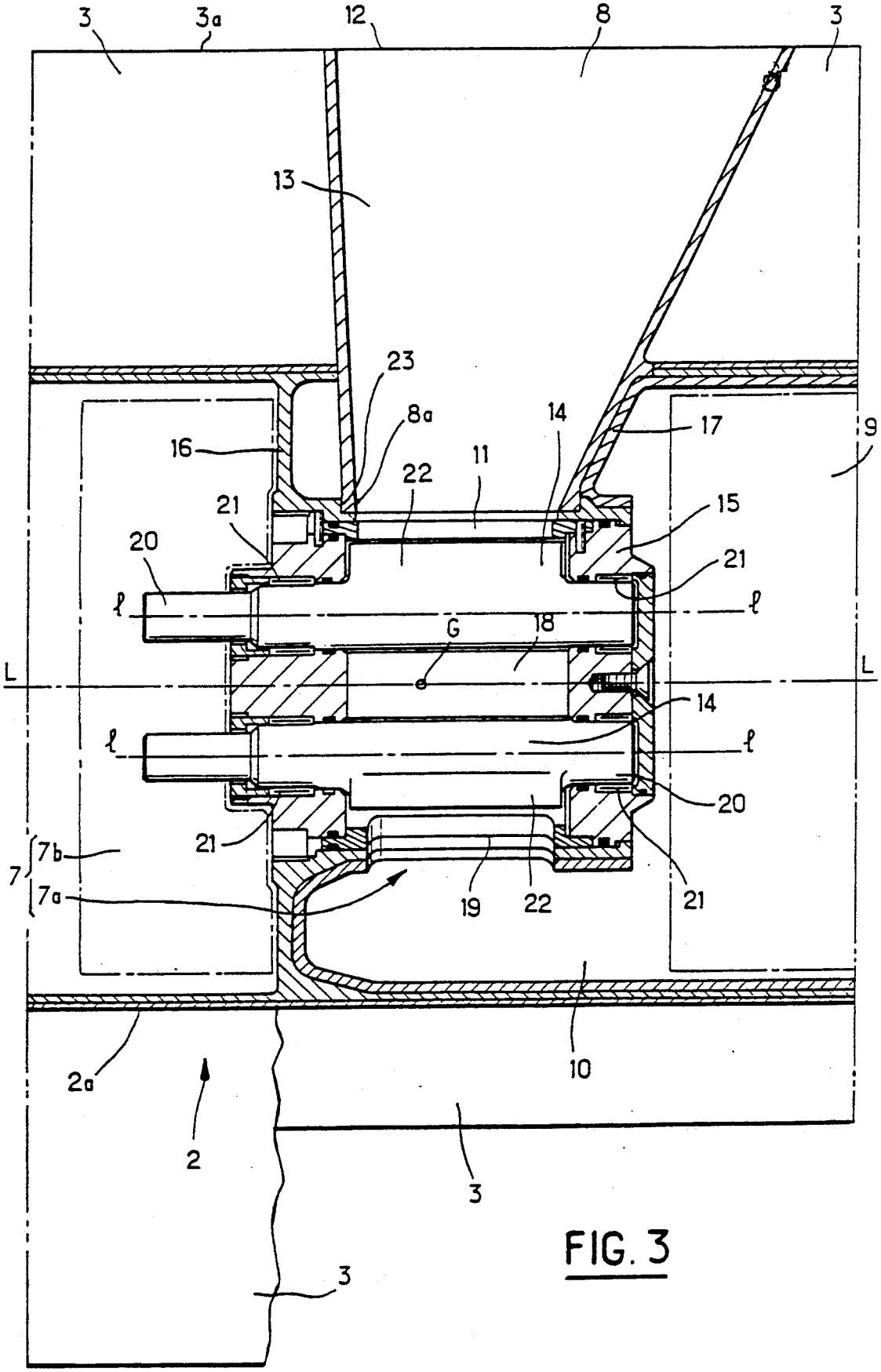
FIG. 3 is a partial longitudinal section of the missile according to the invention, the left and right-hand parts of this figure corresponding respectively to lines III—III and III'—III' of FIG. 2.

The embodiment of the missile 1 according to the invention, shown schematically in FIGS. 1 to 3, comprises an elongate body 2 with axis L—L having wings 3 and tail fins 4. Wings 3 and tail fins 4 are provided with control surfaces 5 and 6, respectively. Wings 3 are four in number and they are diametrically opposite in twos, the planes of two consecutive wings being orthogonal to each other and passing through the axis L—L. Similarly, the tail fins 4 are four in number and they are diametrically opposite in twos, the planes of two consecutive tail fins being orthogonal to each other and passing through axis L—L. In addition, the tail fins 4 are in the bisector planes of wings 3.

In the vicinity of the center of gravity G of missile 1, there is provided in body 2 a force steering device 7 controlling four nozzles 8, diametrically opposite in twos, and disposed in wings 3. Nozzles 8 are placed in the vicinity of the combustion chamber of a gas generator 9, for example with solid propergol, and are connected to said gas generator 9 by ducts 10.

Nozzles 8 may be connected to ducts 10 through an inlet orifice or neck 11 and they open to the outside through an outlet orifice 12, of a larger cross section than the inlet orifice 11, said orifices 11 and 12 being connected together by a divergent portion 13. The outlet orifices 12 are situated at the level of the longitudinal edge 3*a* of wings 3 so that the gas jets passing through nozzles 8 are deviated from the body 2 of the missile and only interfere very little with the aerodynamic flow about the skin 2*a* of said body 2.

As will be explained in greater detail hereafter, each of nozzles 8 is equipped, at the level of its inlet orifice 11, with a valving member or rotary valve 14 (not shown in FIG. 1) for closing or on the contrary opening the corresponding nozzle 8 at least partially.

In flight, without a high load factor, the action of the force steering device 7 is not absolutely necessary, for then missile 1 may be steered conventionally by its aerodynamic control surfaces 5 and 6. Consequently, if the gas generator 9 is of the controlled operation type, it may be stopped. If the gas generator 9 is of the continuous operation type, the valving members 14 of two opposite nozzles are controlled so that the gas jets which they emit exert on the missile forces whose resultant is zero; thus, in this case, as will be seen hereafter, the valving members 14 of two opposite nozzles are constantly half open to let the gases produced by the gas generator 9 escape.

On the other hand, in flight with a high load factor, to cause a sudden change of orientation of the trajectory of the missile, it is necessary to cause at least one of nozzles 8 to function fully, so as to obtain this sudden change of direction. In this case, the valving member 14 of the nozzle(s) controlled to operate is totally retracted so that the lateral and transverse gas jet(s) emitted are considerable and force the missile 1 to suddenly change direction, whereas the valving members 14 of the nozzle(s) which are not operated completely close the corresponding nozzles.

It will be noted that, since they are incorporated in the wings 3, nozzles 8 have the form of a flattened funnel. The outlet orifice 12 is of oblong shape, the large dimension of its cross section being parallel to the longitudinal axis L—L of missile 1, whereas the small dimension of this cross section is transversal to said axis L—L. This small transverse dimension is advantageously constant and the ends of the outlet orifice 12 may be rounded.

The inlet orifice or neck 11, situated on the inner side of missile 1, also has an oblong shape, of constant width and with rounded ends. The cross section of said neck 11 is similar to that of the outlet orifice 12, but smaller than that of this latter. The divergent portion 13 is connected to the two orifices 11 and 12 by an adjusted surface.

The cross section ratio required for sufficiently expanding the combustion gases from the gas generator 9 is largely obtained by determining the respective lengths of orifices 11 and 12.

With the oblong structure of nozzles 8, the lateral steering jets are in the form of sheets having a small front dimension for the aerodynamic flow. Consequently, the interaction between said lateral steering jets and said aerodynamic flow, already lessened by moving the outlet orifices 12 away from skin 2a of body 2 is, if not completely suppressed, at least further reduced so that the aerodynamic elements 3, 4, 5 and 6 may continue to fulfill their function while cooperating with the aerodynamic flow, even when the lateral steering jets are used at maximum power.

As is particularly clear from FIG. 3, the force steering device 7 is formed of two parts 7a and 7b, namely a part 7a in which the valving members 14 are fitted and a part 7b for controlling said valving members.

Part 7a of the force steering device 7 comprises a central rigid block 15, coaxial with axis L—L and forming a case inside which the mobile valving members 14 are disposed. The rigid block 15 is connected rigidly to the internal structure of body 2 of missile 1 by end webs 16, 17. This rigid block 15 is hollow and comprises an internal recess 18 in communication with ducts 10 through peripheral openings 19. Furthermore, the rigid block 15 has other peripheral openings forming the nozzle necks 11 and in communication with the internal recess 18, under the dependence of the valving members 14.

The rotary valving members 14 each comprise a shaft 20 with axis 1—1, parallel to axis L—L of the missile, mounted with respect to the rigid block 15 on low friction bearings 21, for example ball bearings. Each valving member 14 comprises a radial plate 22, fast with the corresponding shaft 20 and projecting outwardly with respect thereto. The external longitudinal face 22a of the radial plate 22 cooperates with the corresponding nozzle neck 11 either for closing it (see the position of valving members 14 at the top left of FIG. 2) or for freeing said nozzle neck 11 at least partially (see the position of the valving members 14 at the bottom right of FIG. 2).

When the valving members 14 are in this closed position, they isolate the internal recess 18 from nozzles 8 and therefore the latter from ducts 10. On the other hand, when the valving members 14 are in a position freeing necks 11, they place nozzles 8 in communication with ducts 10, through said nozzle necks 11, the internal recess 18 and the peripheral openings 19.

The axes 1—1 of the valving members 14 are disposed respectively in the longitudinal median plane of the nozzles 8.

In order to limit the torque opposing opening of the nozzle necks 11 by the valving members 14 (this torque being due to the speeding up of the gases and the depression which results therefrom at the level of said nozzle necks 11), the lateral face 22b of plates 22, facing the nozzle necks 11 in the open position of said valving members 14 is concave and curved, profiled so as to form with the internal wall 18a of the internal recess 18 a portion converging in the direction of said nozzle necks 11. Thus, the curved lateral faces 22a serve as bearing faces for speeding up the gases and transfer the depression generated at a distance from the rotational axes 1—1 of the valving members 14.

The projection of plates 22 with respect to shafts 20 is reduced so that each valving member 14 has very low rotational inertia and a small operating clearance so as to obtain a very short response time with minimum control power. Thus, with such an embodiment of the valving members 14, they have very low inertia, which allows them to have a very reduced response time and limit the torque which opposes opening of the nozzle necks, which avoids the need to provide complex compensation systems.

Of course, the external face 22a of the valving members 14 has a minimum clearance with respect to the internal wall 18a of block 15, so as to reduce the leaks in the closed position, while allowing expansion caused by the high temperature of the gases, for example when they come from a gas generator 9 of powder type. The choice of the component materials of block 15 and of the valving members 14, as well as the choice of their shape may also contribute to minimizing friction: carbon or molybdenum may for example be used protected or not by thermal protection coatings or sleeves.

Moreover, as is shown in FIGS. 2 and 3, the feet 8a of nozzles 8 are fitted into imprints 23, of corresponding shape, provided in the external wall of the rigid block 15, so that the connection between said nozzles 8 and said rigid block 15 is of the sliding fit type. Thus, the nozzles 8, which are fast with the skin 2a of body 2, may follow the deformations of the latter. Thus, the deformations between the internal rigid structure of missile 1 and the external skin 2a of body 2 are dissociated, which are due partly to the high load factor to which the missile 1 is subjected during force steering maneuvers, which deformations might generate operating disturbances.

As can be seen in FIG. 3, shafts 20 of the valving members 14 penetrate inside part 7b (only shown by a chain-dotted line contour) of the force steering device 7, for controlling said valving members 14. In FIGS. 4 to 8, embodiments of this control part 7b have been shown schematically.

Figure 4:
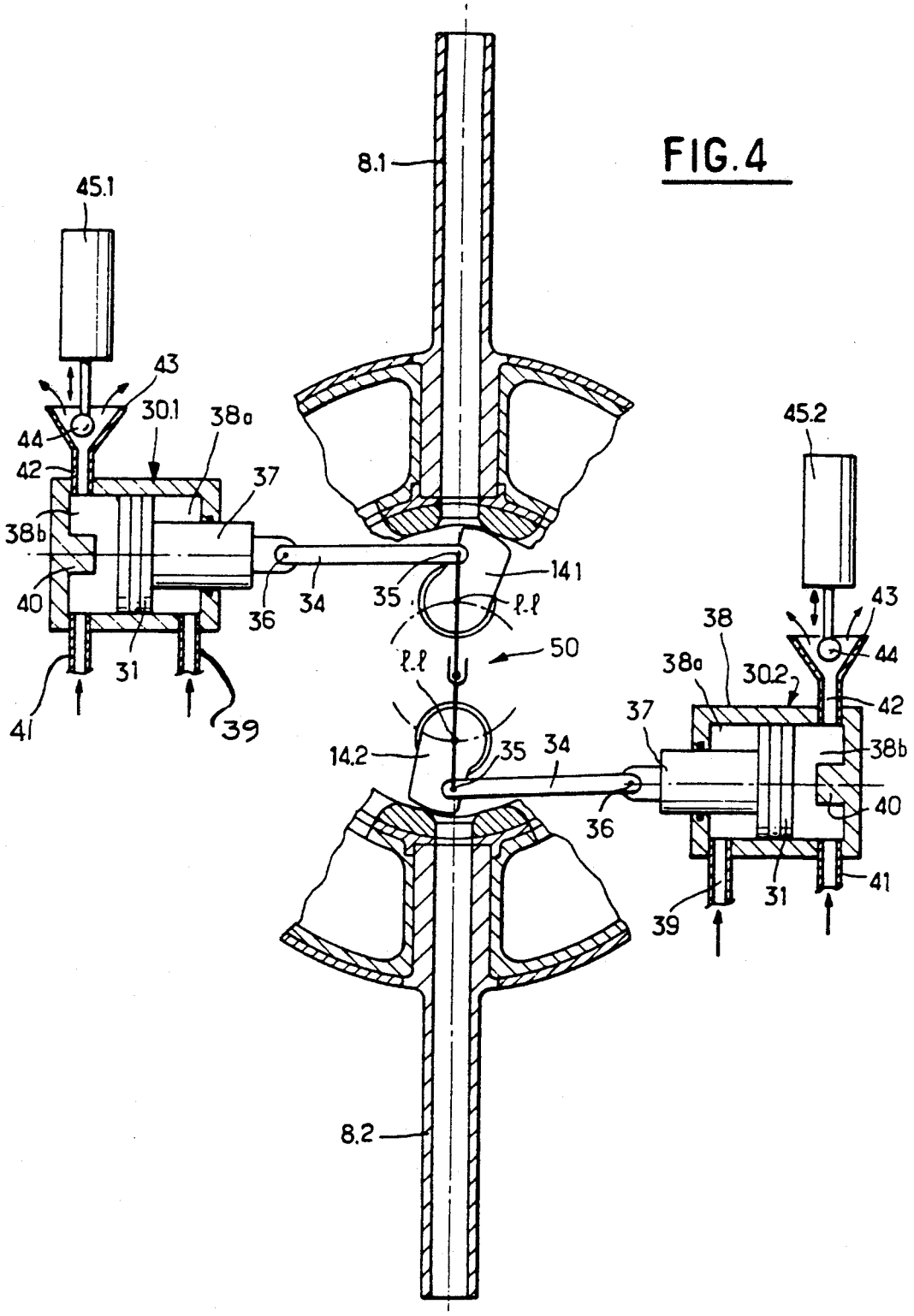
FIG. 4 illustrates schematically the means for actuating each valving member, said valving members being in a median position.

In FIG. 4, a pair of opposite nozzles 8 have been shown, bearing respectively the references 8.1 and 8.2 and associated with respective valving members 14.1 and 14.2. Similarly, the devices associated respectively with said nozzles 8.1 and 8.2 bear the same references with respectively the subscript 1 or 2.

In this FIG. 4 it can be seen that with each valving member 14.1 or 14.2 there is associated a jack 30.1 or 30.2, whose piston 31 is connected to said member 14.1 or 14.2 for example by a link 34, respectively articulated at 35 and 36 to said valving member 14.1 or 14.2 and to the rod 37 of said piston 31.

The piston 31 of each jack 30.1 or 30.2 divides the inside of the corresponding cylinder 38 into two chambers 38a and 38b of different cross sections. In chamber 38a, having the smaller cross section, there opens a duct 39, for example connected to a duct 10 introducing the pressure from generator 9 and intended to push the piston 31 back towards the chamber 38b with the largest cross section, possibly as far as a position such that the valving member 14.1 or 14.2 then closes the neck 11 of the corresponding nozzle 8.1 or 8.2. In this case, piston 31 may come to bear against a stop 40 provided in the chamber of largest cross section 38b defining the minimum volume which the latter may occupy.

In this minimum volume of the chamber with largest cross section 38b of a jack 30.1 or 30.2 there opens an intake duct 41 of calibrated cross section and an exhaust duct 42 of modulable cross section. The intake duct 41 receives, like duct 39, a part, for example about 1%, of the gas flow generated by the gas generator 9 by being for example connected to a duct 10. The exhaust duct 42 is vented, connected for example to the outside of missile 1, so that a slight pressure po prevails in the chamber with the largest cross section 38b. In order to be able to accurately and rapidly modulate the cross section of said exhaust duct 42, the free end thereof is extended by a portion 43 opening out into the form of a funnel and a refractory ball 44 is provided for moving inside said bell-mouth portion 43, in the axis thereof. A motor 45.1 or 45.2, for example a linear electric motor, is provided for such movement of said ball 44. It can be seen that with such a device ball 44 is automatically centered with respect to the duct 42 in the closed position.

When a motor 45.1 or 45.2 is controlled for retracting ball 44 and completely freeing the corresponding exhaust duct 42 (see FIG. 4), i.e. to free between said ball 44 and the facing wall of funnel 43 a flow section at least equal to the cross section of the exhaust duct 42, the gas flow entering through the intake duct 41 escapes freely through said exhaust duct 42, so that this gas flow exerts only the slight pressure po on piston 31, which is pushed back against stop 40 by the action of the gas flow brought by the corresponding duct 39, so that the associated link 34 tends to move the corresponding valving member 14.1 or 14.2 towards the position in which it completely closes the nozzle neck 11.

On the other hand, if a motor 45.1 or 45.2 is controlled to bring the ball 44 closer to the exhaust duct 42, said ball defines with the facing wall of funnel 43 a flow section which gradually decreases. As soon as this flow section becomes less than the cross section of the exhaust duct 42, there is an obstacle to the flow of the gas stream entering through the intake duct 41, so that the gas pressure increases inside the chamber with the largest cross section **38*b*, beyond the value po. As soon as this pressure is sufficiently great to overcome the action of the gas stream brought by duct 39, piston 31 tends to move in the direction in which link 34 causes the corresponding valving member 14.1 or 14.2 to rotate in the direction freeing the nozzle neck 11**.

If ball 44, under the action of motor 45.1 or 45.2, continues to draw closer to exhaust duct 42, the flow section for the gas stream entering through the intake duct 41 further decreases and the pressure inside chamber **38*b* with the largest cross section becomes greater and the corresponding valving member 14.1 or 14.2 tends to take a position in which it completely frees the neck 11 of the associated nozzle 8.1 or 8.2**.

If now the motor 45.1 or 45.2 is controlled to retract ball 44, a gas flow section is again available between said ball 44 and the facing wall of funnel 43, so that the pressure decreases in chamber **38*b* with the largest cross section and the pressure generated by the gas flow brought by duct 39 may push piston 31 back so that the valving member 14.1 or 14.2 rotates in the direction closing neck 11**.

The result is that by controlling motors 45.1 and 45.2 the relative rotation of the valving members 14.1 and 14.2 may be controlled with respect to the necks 11 of the respective nozzles 8.1 and 8.2 and so said missile can be force steered, the position of a valving member 14.1 or 14.2 with respect to the corresponding nozzle neck 11 depending on the balance of the fluid pressure in chambers **38*a* and 38*b***.

Figure 5:
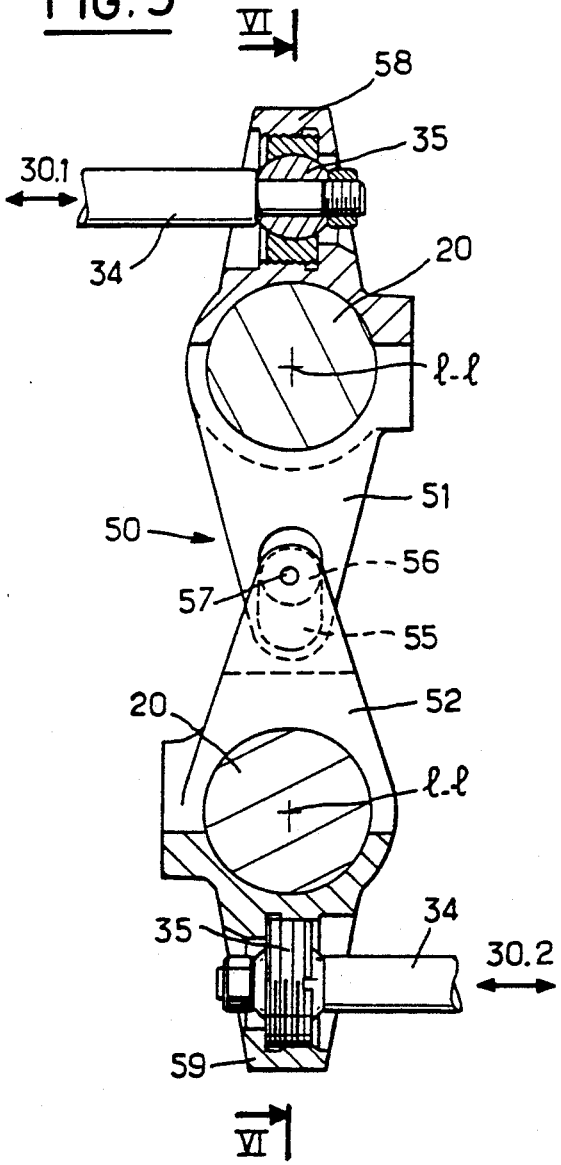
FIG. 5 shows one embodiment of the mechanical coupling connection between said valving members, in elevation with parts cut away and in partial section.
Figure 6:
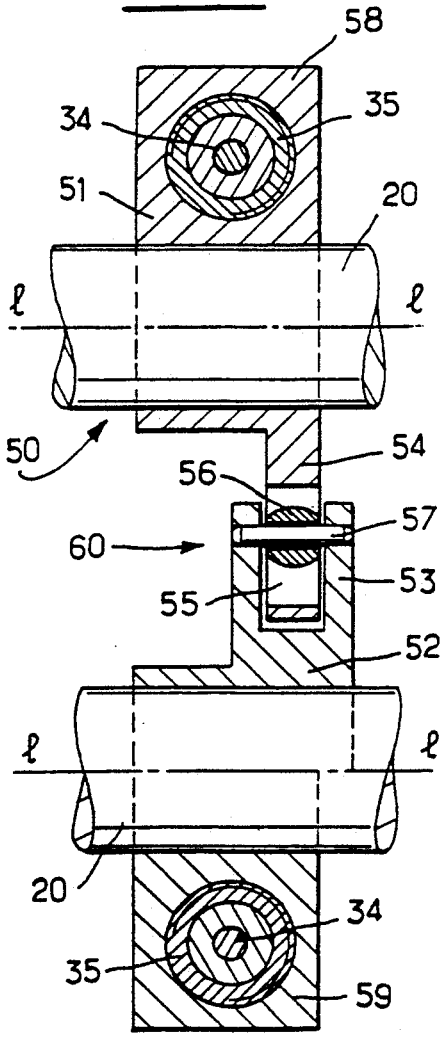
FIG. 6 is a cross section through line VI—VI of FIG. 5.

However, the positions of the valving members 14.1 and 14.2 do not depend solely on the pressures prevailing in chambers **38*a* and 38*b* of jacks 30.1 and 30.2, for said valving members are coupled mechanically together for rotation by a mechanical connection 50, which is shown schematically in FIG. 4, but an embodiment of which is illustrated in FIGS. 5 and 6**.

As can be seen, in this embodiment, said mechanical connection 50 comprises a link 51, interlocked for rotation with shaft 20 of the valving member 14.1, and a link 52 interlocked for rotation with shaft 20 of the valving member 14.2, said links 51 and 52 being directed towards each other and articulated together. For this, for example, link 52 comprises a fork joint 53 in which an end 54 of link 51 is engaged. This end 54 is formed with an oblong opening 55 in which may roll a roller 56 which is mounted for rotation about a shaft 57, fast with link 52 and passing through the fork joint 53, said shaft 57 being parallel to the axes 1—1 of shafts 20.

At their free ends 58 and 59, respectively opposite the oblong opening 55 and the fork joint 53, links 51 and 52 are articulated respectively to links 34 associated with jacks 30.1 and 30.2 by articulations 35, shown in the form of a ball joint.

It can be seen that the oblong opening 55 and roller 56 form, between links 51 and 52, an articulation whose shaft 57 is able to move longitudinally with respect to link 51, when said links rotate with the associated shafts 20.

When, as is shown in FIG. 4, the two motors 45.1 and 45.2 are in their neutral position in which their respective balls 44 are moved away from funnel 43 with which they cooperate and at equal distances therefrom, the exhaust cross sections of the two ducts 42 are identical, so that the same pressure, equal to the above defined value po, prevails in the large cross section chambers **38*a* of jacks 30.1 and 30.2. Furthermore, the smaller cross section chambers 38*a* of jacks 30.1 and 30.2 receive the same gas pressure from generator 9, so that the same pressure also prevails in these chambers equal to that of the gas stream from ducts 10. Consequently the pistons 31 of the two jacks 30.1 and 30.2 occupy identical relative positions and each of nozzles 8.1 and 8.2 is half open. In this neutral position shown in FIG. 4, it is advantageous for the mechanical connection 50 to be itself in a neutral position in which the two articulations 35 and shaft 57 are aligned, as is shown in FIGS. 5 and 6**.

If, from the neutral position shown in FIG. 4, one of the two motors 45.1 or 45.2 is controlled (in FIG. 7 the control of motor 45.2 has been shown), the corresponding ball 44 is brought closer to the associated funnel so that the pressure increases in the corresponding chamber **38*b* and piston 31 is pushed back towards chamber 38*a*. Consequently, the valving member 14.2 rotates in the direction in which it releases the associated nozzle 8.2 more and more. However, because of the mechanical connection 50 which assumes a broken position, the valving member 14.1 is itself forced to rotate, but in the opposite direction. Thus, as the valving member 14.2 gradually opens nozzle 8.2, the valving member 14.1 closes nozzle 8.1. Such a control may be continued until one of the valving members 14.2 is completely open whereas the other is completely closed. This last situation is shown in FIG. 7, where the valving member 14.2 is open and the valving member 14.1** is in the closed position.

Figure 7:
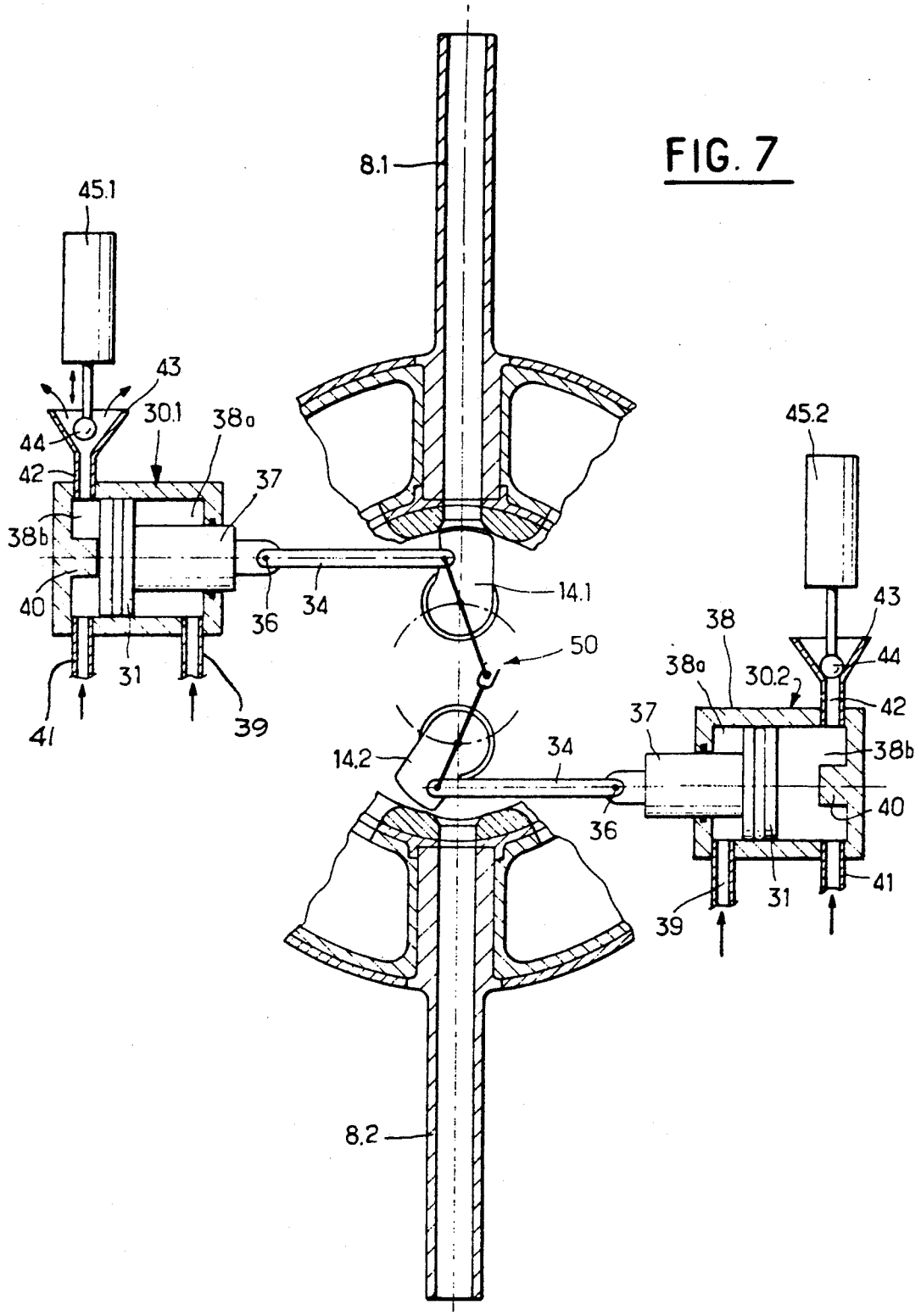
FIG. 7 is a view similar to FIG. 4, one of the valving members being completely closed and the other completely open.
Figure 8:
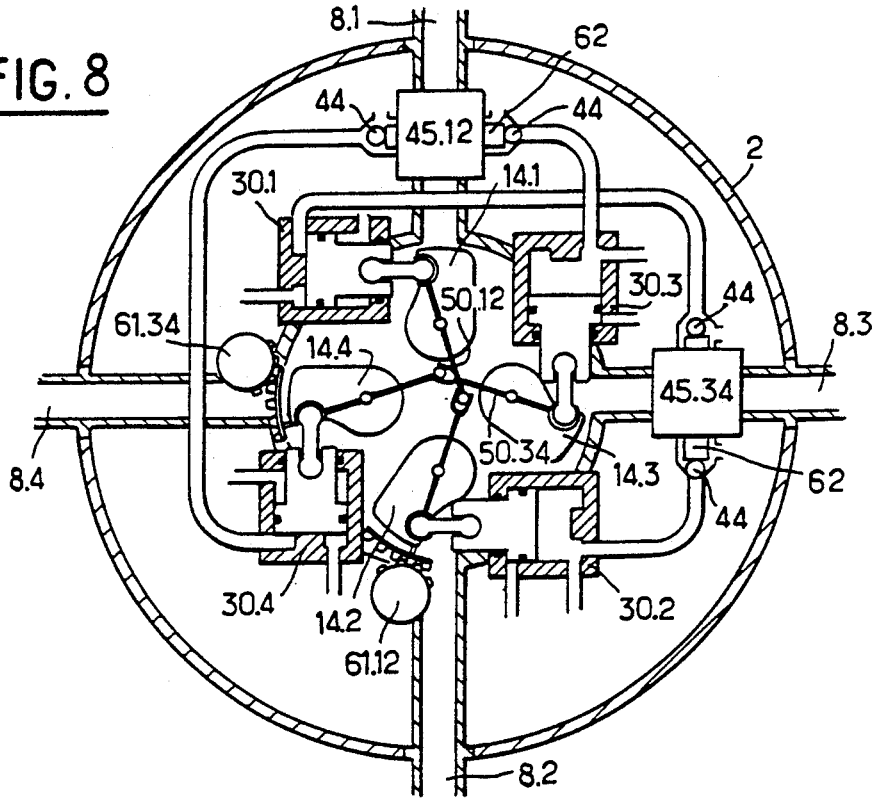
FIG. 8 illustrates schematically the application of the system according to the invention to a missile comprising two pairs of nozzles, in longitudinal and orthogonal planes.

In FIG. 8, the system of FIGS. 4 and 7 has been shown schematically applied to the steering of a missile 1 having four nozzles, diametrically opposite in twos and spaced apart at 90° about the axis L—L of said missile. In this figure, we find again the two opposite nozzles 8.1 and 8.2 described above, to which have been added two identical nozzles 8.3 and 8.4 crossed with said nozzles 8.1 and 8.2. With nozzles 8.3 and 8.4 are associated respectively valving members 14.3 and 14.4 and jacks 30.3 and 30.4. The valving members 14.1 and 14.2 are coupled by the mechanical connection 50.12, whereas the valving members 14.3 and 14.4 are connected by the mechanical connection 50.34. Of course, the mechanical connections 50.12 and 50.34 are similar to connection 50 described above. They intersect close to their articulation, and that is why they comprise a central recess 60 (see FIG. 6).

Furthermore, with each valving member pair 14.1–14.2 and 14.3–14.4 there is associated an element for measuring the position of one of the valving members, bearing respectively the references 61.12 and 61.34. These position measuring elements may be of the potentiometer type and they are intended to communicate, for control of the valving member (not shown), the exact position reached by said valving members. It will be noted that, because of the mechanical connections 50.12 and 50.34 each position measuring element 61.12 and 61.34 delivers signals representative at one and the same time of the positions of the two associated valving members.

In addition, instead of providing a motor 45 per nozzle, as is shown in FIGS. 4 and 7, in this embodiment a single motor 45 is provided for two diametrically opposite nozzles: thus, motor 45.12 controls the valving members 14.1 and 14.2, associated respectively with nozzles 8.1 and 8.2, whereas motor 45.34 controls the valving members 14.3 and 14.4, associated respectively with nozzles 8.3 and 8.4. Each of these motors 45.12 and 45.34 is for example a linear motor of the type described in the patent FR-A-2 622 066 comprising an elongate core 62 movable in translation parallel to itself. A ball 44 is carried by each end of core 62, for cooperating with the funnels 43 associated with the exhaust ducts 42 of the corresponding jacks 30.1 and 30.2 or 30.3 and 30.3, so that when a ball 44 draws close to its associated funnel, the other ball 14 moves away from its funnel and vice versa.

It can be seen that, by controlling motors 45.12 and 45.34 any desired transverse thrust may be obtained for force steering missile 1.

It will be noted that, for the neutral position shown in FIG. 4, the position of balls 44 may be such that the force delivered by a piston 31 is equal to the torque which tends to close each valving member 14. Thus, the mechanical connections 50, which guarantee the operating safely, are little stressed. Furthermore, these mechanical connections 50, disposed in part 7*b* of the system, are outside the gas flow (passing through part 7*a*) so that they are subjected to only moderate temperatures. Rollers 56 may be in the form of a barrel, so that the mechanical connections 50 tolerate reverse flexions.

The transverse thrust steering control may be provided in a known way by a return loop (not shown) ensuring the measurement of the position of each pair of valving members by means of elements 61.12 and 61.34. The operation may be stabilized by speed regulation of motors 45, having for this purpose tachometric generators (not shown), on the difference between the positions asked for and obtained.

Figure 9:
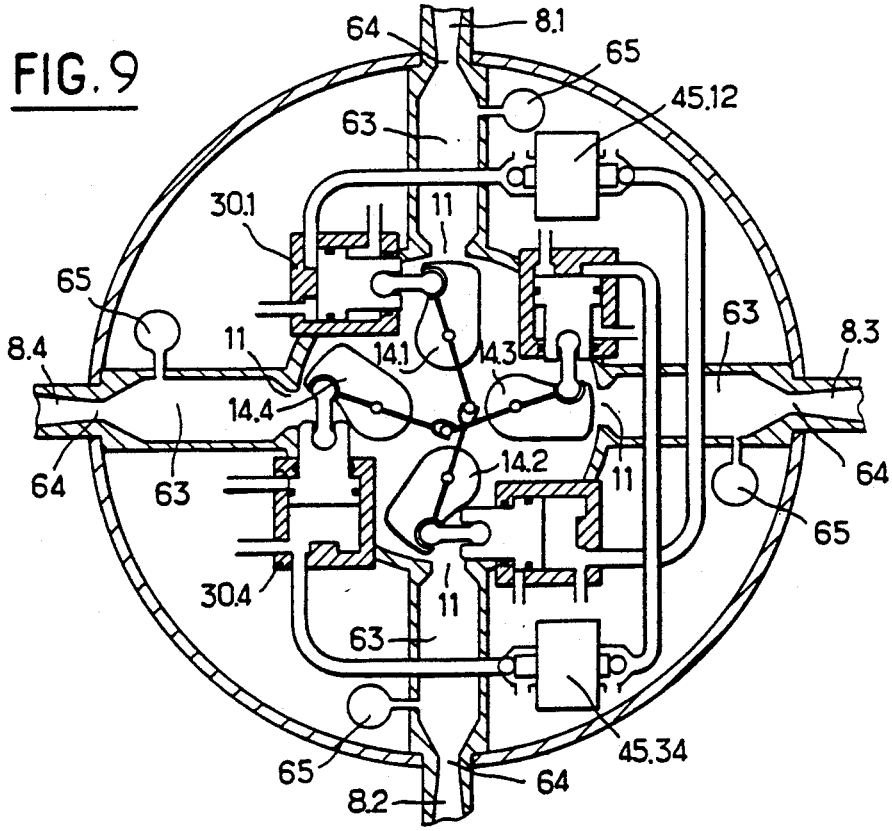
FIG. 9 shows a variant of the control system of FIG. 8.

If, as is shown in FIG. 9, a gas tranquillizing chamber 63 is provided between the nozzle necks and said nozzles 8, these tranquillizing chambers 63 being themselves connected to nozzles 8 by a restriction 64 of known cross section, the gas flow in said nozzles may be subsonic. By measuring the pressure in each chamber 63 by means of devices 65, the thrust of each nozzle 8 and the resultant value for each pair of nozzles can be readily determined.

What is claimed is:

1. System for steering a missile by means of gas jets, comprising a gas generator connectable to at least a pair of lateral nozzles via rotary valving means, movable under the action of drive means and controlling the passage of the gases through said nozzles : wherein:

with each nozzle is associated an individual rotary valving member;

each valving member is controlled in rotation by a piston dividing a jack into two chamber of different cross sections, said chambers each receiving a part of the gas generated by said gas generator , and the position of said piston being controlled by controlling the flowrate of said gas through the chamber with largest cross section, the control of said flows through the chambers with the largest cross section of the two jacks of a pair of lateral nozzles being such that, at a given time, a single one of said flows is likely to be restricted, possibly as far as total cut-off; and the two valving members are connected together by a mechanical connection so that, when one valving member rotates and tends to close the associated nozzle, the other valving member rotates by the same angular amplitude and tends to free the associated nozzle.

2. System as claimed in claim 1, wherein, at least at the level of its neck cooperating with a valving member, each nozzle has an oblong section.

3. System as claimed in claim 2, wherein each valving member comprises a shaft fast with a projecting radial plate whose longitudinal end face cooperates with the neck of the corresponding nozzle.

4. System as claimed in claim 3, wherein the lateral face of the radial plate, opposite the neck of the nozzle in the open position of said valving member, is concave and curved.

5. System as claimed in claim 1, wherein said valving members are mounted in a rigid block integral with the structure of said missile.

6. System as claimed in claim 5, in which said nozzles are formed in wings of said missile integral with the skin thereof, wherein the feet of said nozzles are fitted with a sliding fit in said rigid block.

7. System as claimed in claim 1, wherein control of the gas flow through a jack is obtained by means of a linear motor moving a ball in a bell-mouth portion provided in the circuit of said gas flow.

8. System as claimed in claim 7, wherein the valving members of the two nozzles are controlled by the same motor.

9. System as claimed in claim 1, wherein said mechanical connection comprises two links, respectively interlocked for rotation with a valving member, said links being connected together by their facing free ends via an articulation, whose axis is able to move longitudinally with respect to one of said links.

10. System as claimed in claim 9, wherein said mechanical connection is disposed away from the gas flows emitted by said gas generator.

11. System as claimed in claim 9, wherein each link is interlocked for rotation with the shaft of the corresponding valving member and wherein, at its end opposite said articulation with the other link, each link is articulated to the piston of the corresponding jack.

12. System as claimed in claim 11, for a pair of diametrically opposite nozzles, wherein, in the neutral position, the two articulations of the links to said jacks and the articulation between said links are aligned and wherein the two valving members half close the corresponding nozzles.

13. System as claimed in claim 1, wherein, downstream of its neck cooperating with the corresponding rotary valving member, each nozzle comprises a gas tranquillizing chamber, connected to said nozzle, on the side opposite said neck, by a restriction such that the gas flow inside said nozzle is subsonic.

14. System as claimed in claim 13, wherein a measuring device is provided for measuring the pressure in each tranquillizing chamber.

* * * * *